US005435801A

United States Patent [19]

Hung

[11] Patent Number: 5,435,801

[45] Date of Patent: Jul. 25, 1995

[54] MULTI-FUNCTIONAL SPORTING EQUIPMENT

[76] Inventor: Michael Hung, 9-16, Nan Kan Hsia, Nan Kan, Lu Chu Hsiang, Tao Yuan County, Taiwan

[21] Appl. No.: 282,493

[22] Filed: Aug. 1, 1994

[51] Int. Cl.[6] ..... A63B 21/04

[52] U.S. Cl. ..... 482/130; 482/112; 482/52; 482/123; 482/138

[58] Field of Search ..... 482/121, 122, 123, 129, 482/130, 111, 112, 52, 138

[56] References Cited

U.S. PATENT DOCUMENTS

| | | | |
|---|---|---|---|
| 1,561,979 | 11/1925 | Gore | 482/130 |
| 1,973,945 | 9/1934 | Chavin et al. | 482/130 |
| 4,240,627 | 12/1980 | Brentham | 482/138 |
| 4,666,151 | 5/1987 | Chillier | 482/130 |

*Primary Examiner*—Richard J. Apley

*Assistant Examiner*—Lynne A. Reichard

*Attorney, Agent, or Firm*—Wenderoth, Lind & Ponack

[57] ABSTRACT

A multi-function exercise machine includes an I-shaped base, an erect mast and a supporting post. The mast, which is erected on the base has a headrest slidably mounted thereon. A curved handbar is attached to the rear of the headrest. An elastic rope is attached to the curved handbar at the end thereof. The other end of the elastic rope is guided through a pulley disposed within the mast. By this arrangement, the elastic force of the wound rope can be applied to a user then the user conducts a bowing movement. A pair of L-shaped supports are rotatably mounted through supporting legs adjacent to the seat. The supporting legs for the L-shaped supports are spring-biased to apply a load to the feet when a user is conducting a clamping movement. When the spring is attached to the rear part of the supporting legs, the L-shaped supports can be used to conduct a feet expanding movement.

2 Claims, 6 Drawing Sheets

MULTI-FUNCTIONAL SPORTING EQUIPMENT

BACKGROUND OF THE INVENTION (a) Field of the Invention

This invention relates to an exercise machine, more particularly, to a multi-function exercise machine which facilitates a variety of different exercise movements, such as stepping, bowing, expanding the feet and clamping the feet to strengthen the muscles in different parts of the body.

(b) Description of the Prior art

There are many exercise machines available on the market. Each of the conventional exercise machines feature a designed function and a compact and simple configuration in order to decrease the cost.

No doubt each conventional exercise machine can strengthen a special part of the body. For example, an exercise machine for bowing may incorporate a counterweight or a hydraulic cylinder to apply a load to the muscles. But this exercise machine has a comparably complicated configuration and high cost.

Conventional exercise machines for expanding or clamping the feet also have a complicated configuration. As mentioned above, each exercise machine has a designed function which can be used in doing a movement other than the designed movement. It can be concluded that the conventional exercise machines still have room for improvement.

SUMMARY OF THE INVENTION

It is the object of this invention to provide a multi-function exercise machine which features a compact configuration.

It is a further object of this invention to provide a multi-function exercise machine which can be used to conduct different exercises.

In order to achieve the above objects, a mast is erected from a base with a slidably mounted headrest. A curved handbar is attached to the end of the headrest. An elastic rope is attached to the curved handbar at one end. The other end of the elastic rope is guided through a pulley disposed within a main frame. By this arrangement, the rope can be applied to the user when the user conducts a bowing movement.

In another aspect of this invention, a pair of L-shaped supports are rotatably mounted on the main frame through supporting legs adjacent to the seat. These supporting legs for the L-shaped supports are spring-biased to apply a load to the feet when the user conducts a clamping movement with their legs. When the spring is attached to the rear part of the supporting legs, the L-shaped supports can be used to conduct a feet expanding movement.

BRIEF DESCRIPTION OF THE DRAWINGS

The structural and operational characteristics of the present invention and its advantages as compared to the known state of the prior art will be better understood from the following description, in conjunction with the attached drawings, which show illustratively, but not restrictively, an example of a multi-function exercise machine. In the drawings.

DETAILED DESCRIPTION OF THE PREFERRED EMBODIMENT

Figure 1:
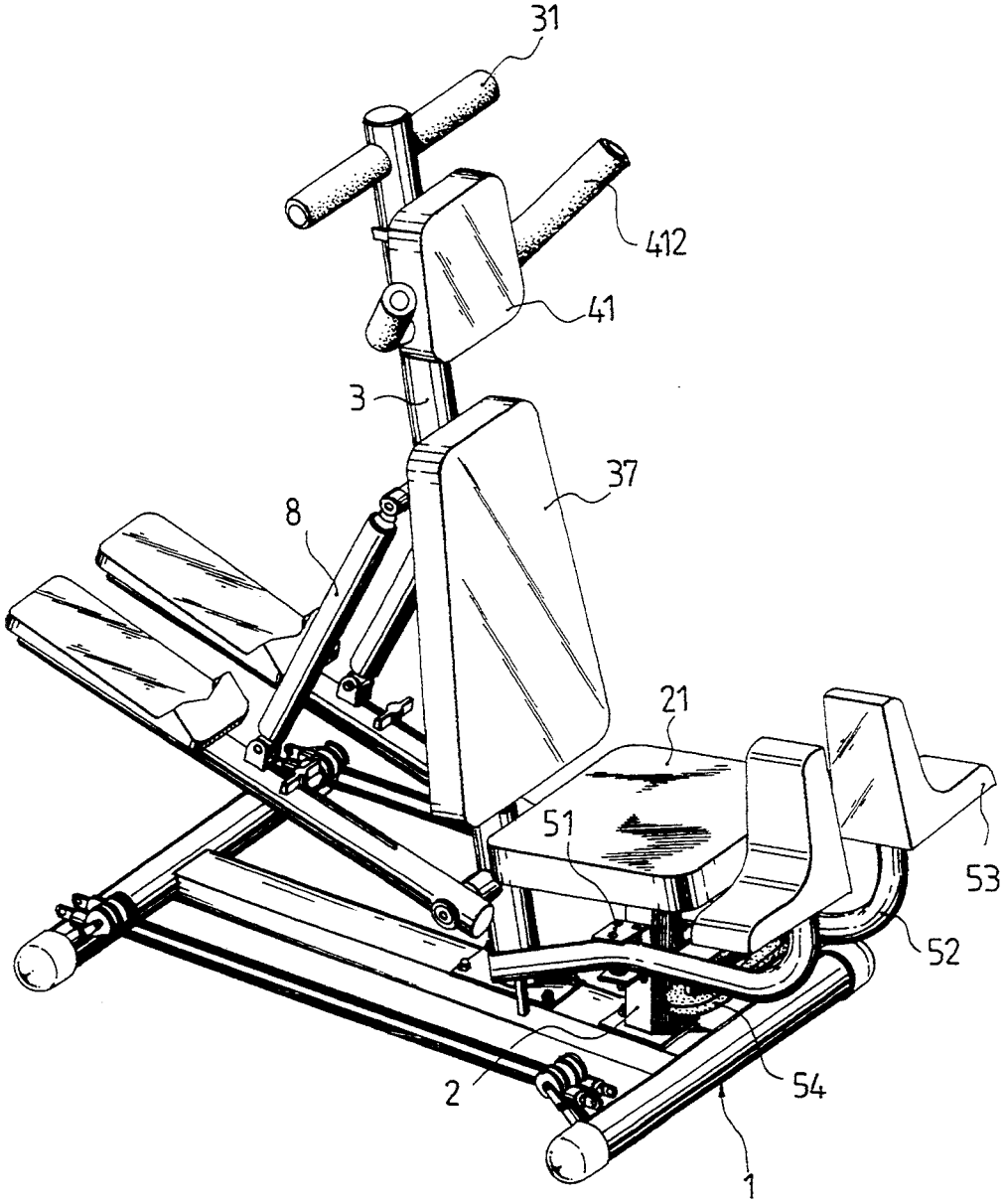
FIG. 1 is a perspective view of a multi-function exercise machine made according to this invention.
Figure 2:
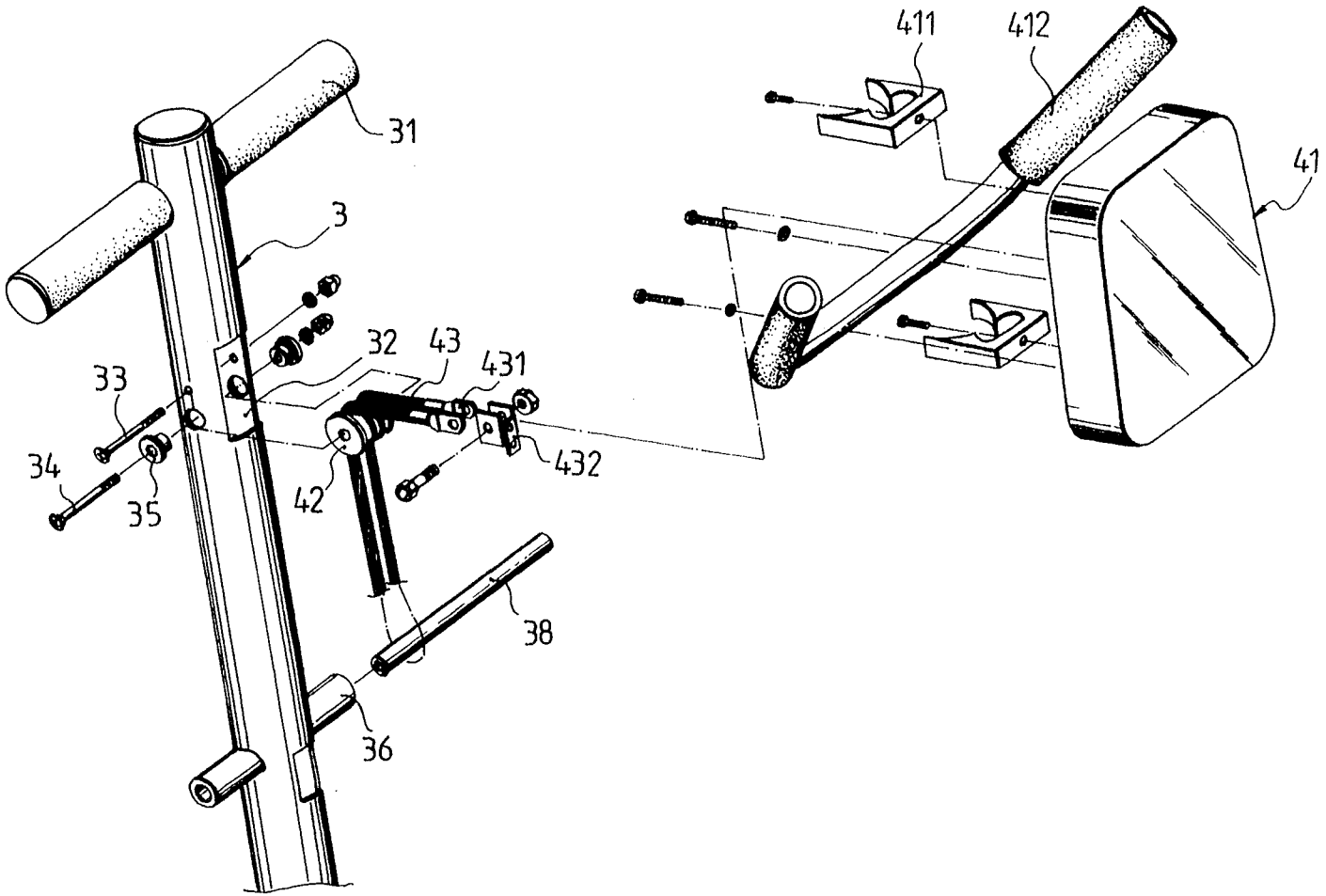
FIG. 2 is an exploded perspective view of a bowing device incorporated into the multi-function exercise machine.

Referring to FIG. 1, a multi-function exercise machine which facilitates stepping, bowing, feet expanding and feet clamping exercises to strengthen the muscles in different parts of the body includes an I-shaped base 1 having a supporting post 2 at a front end thereof. A seat 21 is disposed on the supporting post 2. A mast 3 is erected on the I-shaped base 1. A stationary handbar 31 is fixed to the top of the mast 3. When a user conducts a stepping movement, the stationary handbar 31 provides a support for the user. An opening slot 32 is provided at the upper portion of the mast 3. The upper and lower portion of the opening slot 32, clearly shown in FIG. 2, are provided and mounted with a bolt member 33 and a shaft member 34 incorporated with a washer 35. A traverse tube 36 and a headrest 41 are disposed at the mast 3 below the opening slot 32. A traverse shaft 38 is inserted into the traverse tube 36.

A pair of hydraulic cylinders 8 are disposed between the mast 3 and the I-shaped base 1. Accordingly, a bowing device, an expanding and clamping device and a stepper are disposed between the supporting post 2 and the mast 3 of the I-shaped base 1.

Because the stepper is of a conventional configuration, no further description will be made of the stepper.

The bowing device incorporated in the multi-function exercise machine includes the headrest 41 slidably mounted on the mast 3. A pulley 42 and an elastic rope 43 are incorporated with the headrest 41 to facilitate the bowing movement.

The headrest 41 is provided with a pair of retaining sleeves 411 to receive and retain a curved bar 412 thereon.

The pulley 42 is rotably mounted within the opening slot 32. The shaft 34 is supported by the sidewall of the slot 32.

The elastic rope 43 is provided with a retaining plate 431 at each end of the rope. One end of the elastic rope 43 is wound over the traverse shaft 38 that is inserted within said traverse tube 36. Then both of the retaining plates 431 are extended from the opening slot 32 of the mast 3 and received and retained by a locking socket 432.

With this arrangement, the retaining plates 431 of the elastic rope 43 are received and retained by the retaining socket 432 on the rear portion of the headrest 41. On the other hand, the retaining sleeves 411 can be readily mounted on the mast 3.

Figure 5:
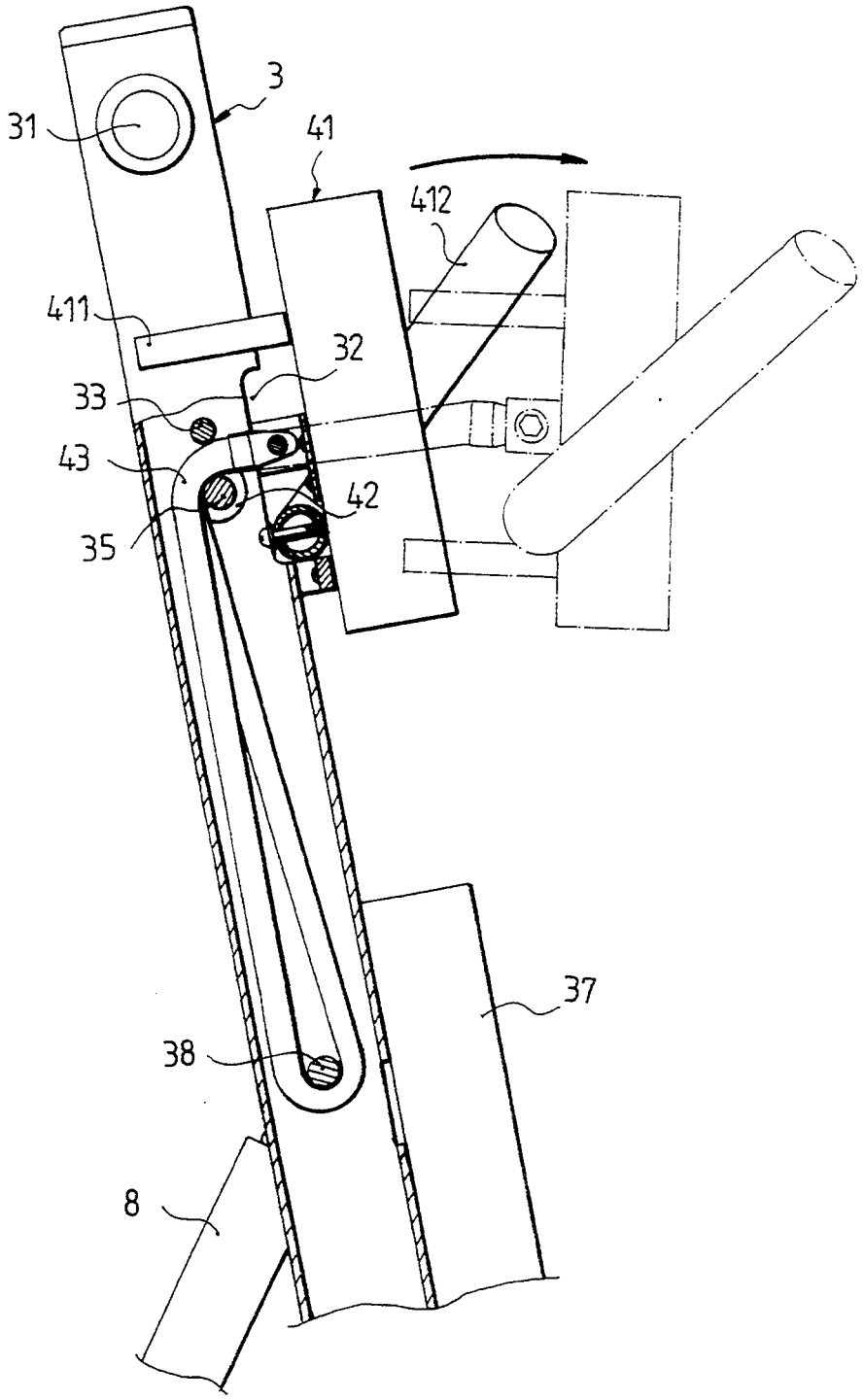
FIG. 5 is a partly cross sectional view showing the movement of the bowing device.

As shown in FIG. 5, the headrest 41 can be readily pulled out from its retained position. The user can then hold onto the curved handbar 412 to conduct a bowing movement while the elastic rope 43 will apply a load to the user. The bolt 33 disposed above the pulley 42 retains the elastic rope 43 within the pulley 42. Accordingly, the elastic rope 43 will not escape from the pulley 42.

Figure 3:
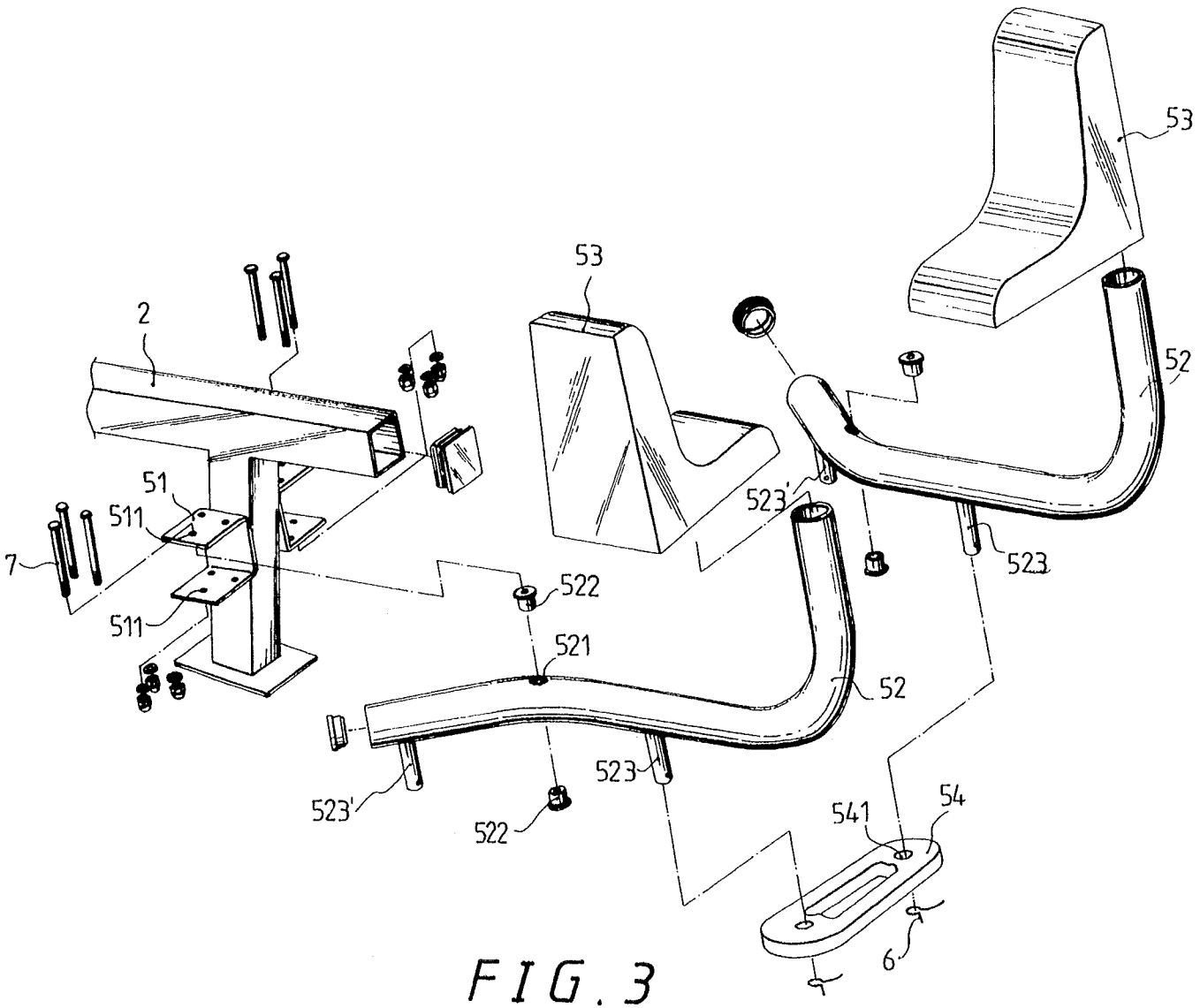
FIG. 3 is an exploded perspective view of an expanding and clamping device incorporated into the multi-function exercise machine.

As shown in FIG. 3, the expanding and clamping device includes a pair of supporting brackets 51, a pair of supporting legs 52, a pair of L-shaped supports 53 and a biasing spring 54.

The supporting brackets 51 are attached to the sidewall of the supporting post 2. Each of the supporting brackets 51 is provided with a pivoting hole 511.

The supporting legs 52 have a curved portion which is provided with a pivoting hole 531 therein. A sleeve 522 is inserted into the pivoting hole 521. Vertical rod 523 and 523' are provided at the lower portions of the supporting legs 52 adjacent to the center of the pivoting hole 521.

Each front end of the supporting legs 52 is provided with one of the L-shaped supports 53.

The biasing spring 54 has a positioning hole 541 at both ends thereof which can be slipped onto the vertical rods 523 or 523' to provide a biasing load to the L-shaped support 53.

Figure 4:
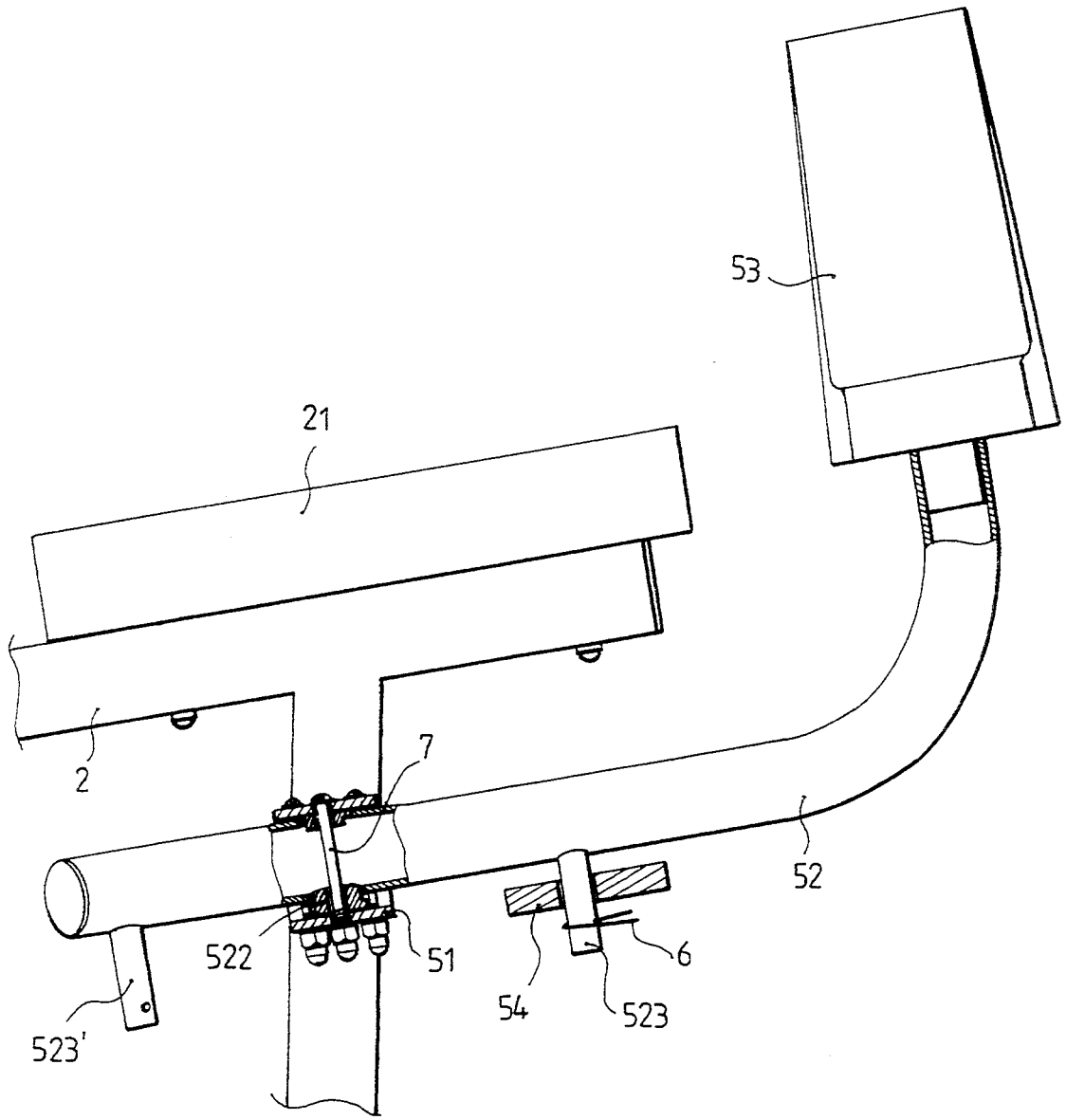
FIG. 4 is a cross sectional view of the expanding and clamping device incorporated into the multi-function exercise machine.

In assembling, the supporting legs 52 can be pivoted onto the supporting bracket 51 by means of a screw member 7 passing through the pivoting hole 511 and the sleeve 522 which is inserted into the pivoting hole 521, as shown in FIG. 4. The L-shaped supports 53 are then mounted onto the front ends of the supporting legs 52. The biasing spring 54 is disposed between the vertical rods 523 to provide a biasing load to the L-shaped supports 53.

Figure 7:
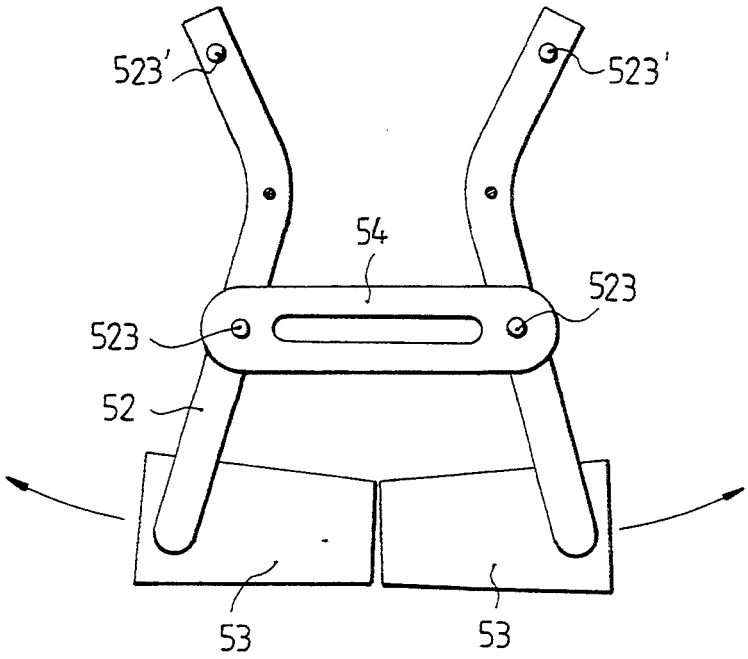
FIG. 7 shows the expanding and clamping device with the spring attached to a middle portion thereof to perform a feet expanding exercise.
Figure 6:
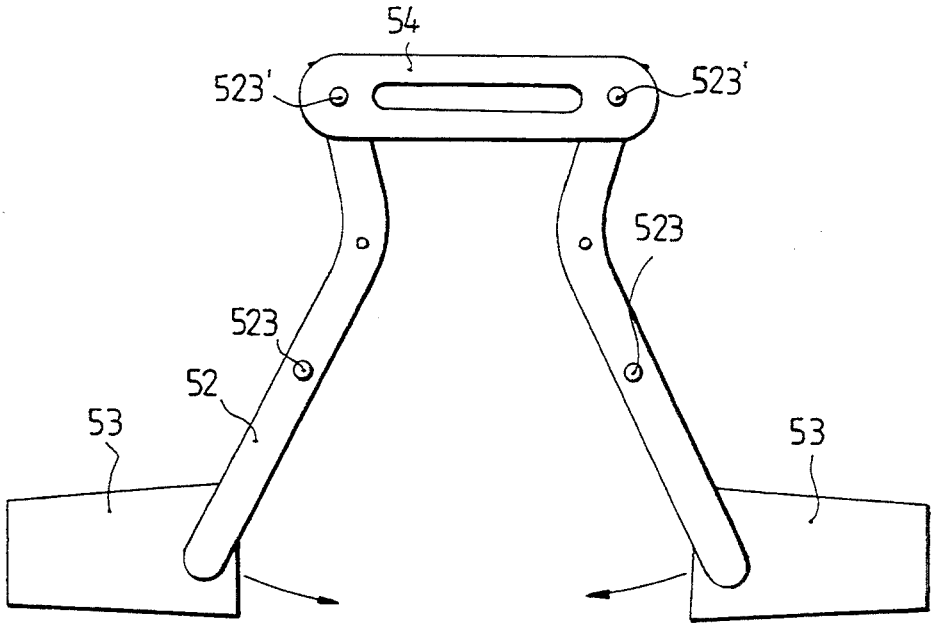
FIG. 6 shows the expanding and clamping device with a spring attached to a rear end thereof to perform a feet clamping exercise.

Referring to FIGS. 6 and 7, if the biasing spring 54 is disposed between the vertical rods 523, then the user can utilize the L-shaped support 53 to conduct an expanding exercise with their feet. When the biasing spring 54 is disposed between the vertical rods 523', then the user can utilize the L-shaped supports 53 to conduct a clamping exercise with their feet.

Basically, the L-shaped supports 53 are rotatably centered on the free ends of the supporting legs 52. Accordingly, the user can select the direction of the L-shaped supports 53 based on whether the expanding or clamping exercise is desired.

In conducting the exercise, the user can sit on the seat 21 and rest their feet on the L-shaped supports 53. Then the user can conduct a suitable exercise, expanding or clamping the L-shaped supports 53. As a result, the muscles of the feet can be strengthened by conducting these exercises.

The free ends of the vertical rods 523 and 523' can have windings 6 attached therewith to prevent the biasing spring 54 from coming off.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. A multi-function exercise machine, comprising:

an I-shaped base having a front end with a supporting post thereat, a seat disposed on said supporting post, a mast extending upwardly from said I-shaped base, and a backrest located at a position between said supporting post and said mast;

a bowing device mounted on said mast, wherein said mast has an opening slot at an upper end thereof and a traverse rod disposed below said opening slot, and wherein said bowing device comprises a pulley disposed on a mounting shaft within said opening slot, a headrest having a rear side and an elastic rope having opposite ends each provided with a retaining plate, said elastic rope being wound onto said traverse rod and guided by said pulley, and said retaining plates being received at and retained on said rear side of said headrest; and an expanding and clamping device mounted at least indirectly to said I-shaped base.

2. The multi-function exercise machine of claim 1, wherein:

said support post has sidewalls;

said expanding and clamping device comprises a pair of support brackets attached to said sidewalls of said supporting posts, a pair of supporting legs pivotably supported on said pair of support brackets, a pair of L-shaped supports on said pair of support legs and a biasing spring interconnecting said support legs;

each of said pair of support legs comprises a front end, a lower portion, a curved portion having a pivoting hole therein through which each of said supporting legs is supported on a respective one of said pair of support brackets and a vertical rod on said lower portion adjacent to said pivoting hole;

each of said L-shaped supports is disposed at said front end of a respective one of said pair of support legs; and said biasing spring has a positioning hole at each end thereof slipped over said vertical rods on said support legs to provide a biasing load to said L-shaped supports.

* * * * *